US006899514B2

(12) United States Patent
Elsmark et al.

(10) Patent No.: US 6,899,514 B2
(45) Date of Patent: May 31, 2005

(54) OVERSPEED SAFETY DEVICE

(75) Inventors: Karl-Johan Lars Elsmark, Saltsjö-Boo (SE); Gunnar Christer Hansson, Stockholm (SE); Anders Urban Jansson, Älvsjö (SE)

(73) Assignee: Atlas Copco Tools AB, Nacka (SE)

( * ) Notice: Subject to any disclaimer, the term of this patent is extended or adjusted under 35 U.S.C. 154(b) by 29 days.

(21) Appl. No.: 10/696,424

(22) Filed: Oct. 28, 2003

(65) Prior Publication Data

US 2004/0086374 A1 May 6, 2004

(30) Foreign Application Priority Data

Oct. 31, 2002 (SE) ..... 0203207

(51) Int. Cl.[7] ..... F01B 25/00

(52) U.S. Cl. ..... 415/25; 415/41; 415/42; 415/904; 137/50; 137/53; 137/57

(58) Field of Search ..... 415/21, 25, 30, 415/36, 41, 42, 43, 904, 202; 137/50, 53, 56, 57; 418/40, 41, 42, 43, 44

(56) References Cited

U.S. PATENT DOCUMENTS 4,278,103 A * 7/1981 Giardino ..... 137/50
4,298,317 A * 11/1981 Hansson ..... 418/43
6,179,552 B1 1/2001 Jacobsson

* cited by examiner

*Primary Examiner*—Edward K. Look
*Assistant Examiner*—Dwayne J. White
(74) *Attorney, Agent, or Firm*—Frishauf, Holtz, Goodman & Chick, P.C.

(57) ABSTRACT

An overspeed safety device for a pneumatic rotation motor having a stator (10) with an air inlet passage (16), a rotor (12), and a speed governor for determining a maximum speed level, and comprising a speed responsive actuator (34) connected to the rotor (12) and a valve (33) shiftable by the actuator (34) from a normally open position to a closed position so as to block or substantially restrict the air flow through the inlet passage (16) at the attainment of motor speed levels exceeding a predetermined maximum level should the speed governor malfunction, wherein the actuator (34) comprises a spring biassed contact element (48) connected to the rotor (12) and responsive to centrifugal action, and the valve (33) comprises a disc-shaped valve element (36) pivotally supported in the inlet passage (16) and maintained in its open position by one magnet (42) and in its closed position by another magnet (43).

10 Claims, 2 Drawing Sheets

OVERSPEED SAFETY DEVICE

The invention relates to an overspeed safety device for a pneumatic rotation motor having a stator with an air inlet passage, a rotor, and a speed governor for determining a maximum speed level, and which comprises an actuator connected to the motor rotor, and a valve element arranged to be shifted by the actuator from an open position to a closed position to block the air inlet passage should the motor speed exceed the predetermined maximum level due to speed governor malfunction.

It is a well known and commonly used technique to provide rotation motors of power tools, for instance portable grinding machines, with a safety device to prevent the motor from over-revving, i.e. reaching speed levels above a predetermined maximum level normally controlled by speed governor. Such overspeed levels might cause blowing-up of the grinding disc and be a danger to the operator and other people at the working site. So, an overspeed safety device is intended to prevent that the motor despite a malfunctioning speed governor could reach hazardous high speed levels.

Many types of overspeed safety devices, however, suffer from malfunctioning problems themselves mainly due to stuck valve elements. This problem is particularly occurring in safety devices having linearly guided valve elements on which undesirable frictional and/or sticking forces easily occur. By nature, this type of mechanism remains inactive for relatively long periods of tool use during which the speed governor works properly, and by influence of for instance oil and dirt particles the valve element sometimes got stuck on its own guide surfaces. Normally, the overspeed device valve element is maintained in its open position by a mechanical trip means which also may be a source of malfunction, thereby jeopardising the overspeed safety function of the tool. It is crucial for the safety of the operator and an aim for the safety function of the tool that the overspeed safety valve is 100% reliable and that the valve element could never get stuck in its open position.

An example on a power tool having an overspeed safety device of a type having both a linearly movable valve element and a mechanical trip means is described in U.S. Pat. No. 6,179,552.

The main object of the invention is to solve the above problems by providing an overspeed safety device for a pneumatic rotation motor, which comprises an air inlet passage controlling valve element of a non-sliding type, and a non-mechanical holding means for retaining the valve element in open position at normal motor speed levels and releasing the valve element for movement towards closed position at overspeed levels of the motor.

A further object of the invention is to provide with an overspeed safety device for a pneumatic motor having a very compact design and which is possible to locate inside the air inlet passage of the motor.

Further objects and advantages of the invention will appear from the following specification and claims.

A preferred embodiment of the invention is below described in detail under reference to the accompanying drawings.

In the drawings

Figure 1:
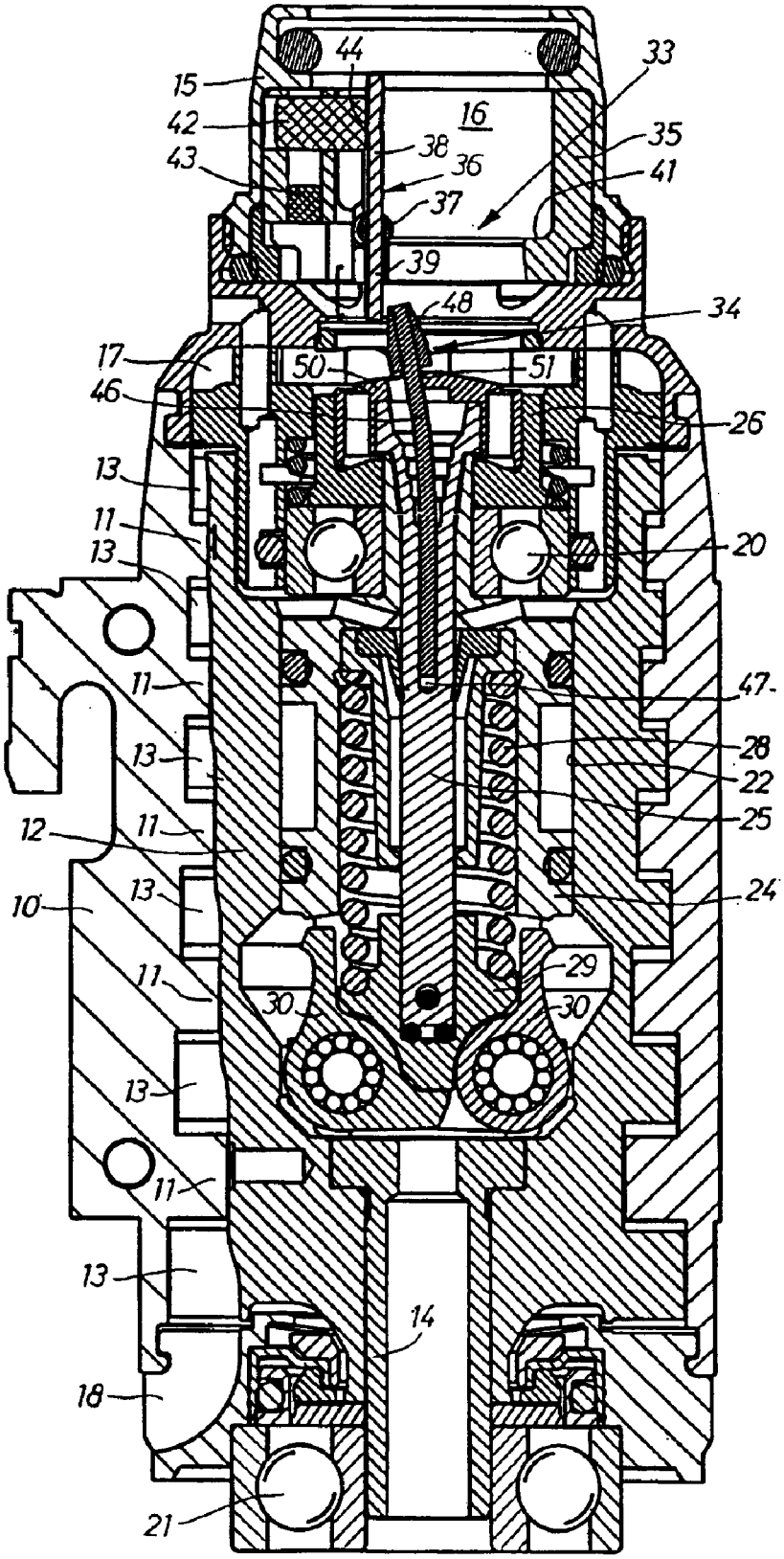
FIG. 1 shows a longitudinal section through a pneumatic motor including an overspeed safety device according to the invention illustrated in its inactivated open position.

The motor shown in the drawings is a pneumatic multi-stage turbine motor which comprises a stator 10 formed with guide vanes 11 arranged in a number of circumferential rows for directing a flow of pressure air to a rotor 12 carrying drive blades 13. The drive blades 13 are arranged in a number of circumferential rows, each located between two adjacent rows of guide vanes 11. The rotor 12 is provided with a drive sleeve 14 for connection to an external load.

At its rear end, the stator 10 is provided with a tubular inlet portion 15 defining a co-axial air inlet passage 16 for pressure air. Moreover, the stator 10 comprises a radially extending air feed passage 17 communicating with the inlet passage 16 and leading pressure air onto the drive blades 13 of the turbine rotor 12. Downstream of the drive blades 13 and the guide vanes 11 the stator 10 is provided with an exhaust air outlet 18.

The rotor 12 is journalled in the stator 10 via two bearings 20,21 and is formed with a central bore 22 for supporting a mechanical speed governor. The speed governor comprises a support member 24 which is mounted in the bore 22 and in which is slidable a central spindle 25. At its rear end, the spindle 25 is connected to a cylindrical valve element 26. The speed governor further comprises a spring 28 for exerting a bias load on the central spindle 25 via an end piece 29 in the opening direction of the valve element 26. A pair of flyweights 30 are pivotally supported on the support member 24 and arranged to exert an activation force onto the end piece 29 of the spindle 25 to urge the spindle 25 and the valve element 26 rearwards in the closing direction against the axial load of the spring 28 to restrict the air flow through the air feed passage 17 as the rotor speed attains a predetermined maximum level.

The speed governor is not new in itself but is previously described in U.S. Pat. No. 6,179,552.

At the rear end of the motor there is located an overspeed safety device for blocking the air inlet passage 16 or at least restricting substantially the air flow therethrough should the motor speed attain levels above the maximum speed level normally determined by the speed governor. The overspeed safety device comprises mainly a valve 33 and an actuator 34. The valve 33 consists of a tubular valve housing 35 and a disc-shaped valve element 36 made of a ferrous material and supported in the valve housing 35 on two oppositely directed gudgeon pins formed by a transverse spindle 37. The latter is located offset in relation to the centre of valve element 36 as well as to the longitudinal central axis of the inlet passage 16 and act as a pivot for the valve element 33. The valve element 36 comprises a main portion 38 located on one side of the pivot axis and a secondary portion 39 located on the opposite side of the pivot spindle 37. The valve 33 further comprises a part-circular valve seat 41 to be engaged by the valve element 36 in the activated closed position of the valve 33.

Figure 2:
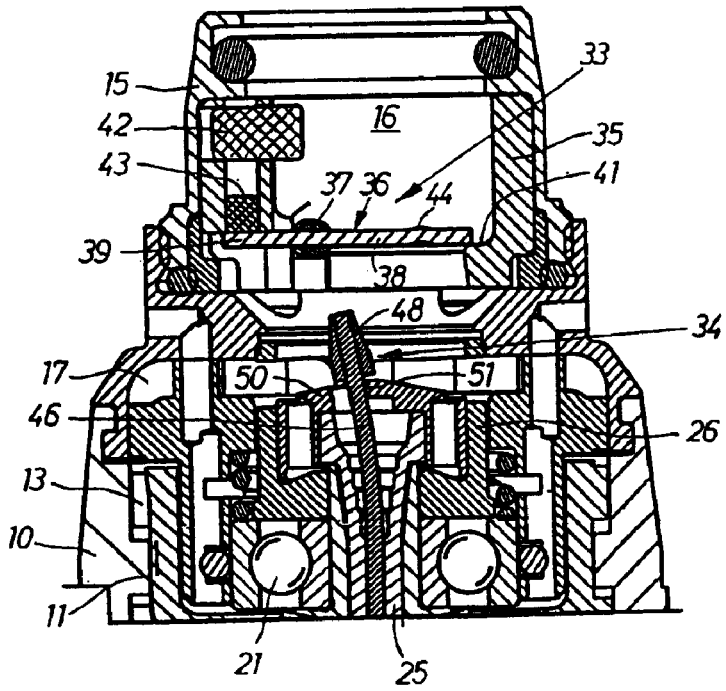
FIG. 2 shows a fractional section of the device in FIG. 1, illustrating the overspeed safety device in its activated closed position.
Figure 3:
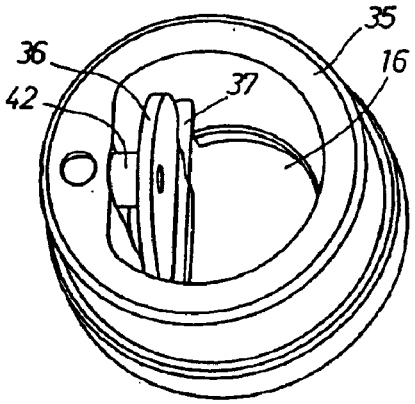
FIG. 3 shows a perspective end view of the overspeed safety device in FIG. 1 illustrating the inactivated open position.
Figure 4:
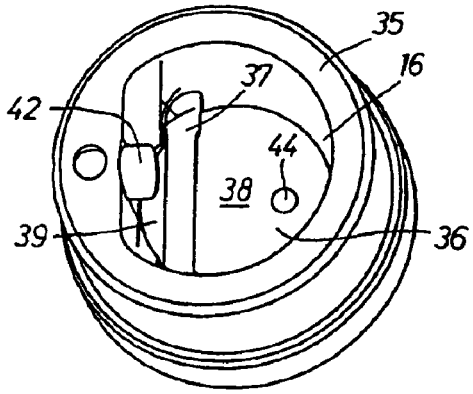
FIG. 4 shows a perspective end view of the overspeed safety device in FIG. 1 illustrating the activated closed position.

In the valve housing 35 there are mounted two magnets 42,43, one of which 42 is intended to attract the ferrous valve element 36 and retain the latter in its open position during normal operation of the motor, see FIGS. 1 and 3, whereas the other one 43 is disposed so as to retain the valve element 36 in its closed position. See FIGS. 2 and 4. The magnet 42 is arranged to engage the main portion 38 of the valve element 36, whereas the magnet 43 engages the secondary portion 39 of the valve element 36. For obtaining a more accurate engagement between the magnet 42 and the valve element 36 in open position the latter is formed with a small spherical protrusion 44. This arrangement makes the retaining force acting on the valve element 36 less dependent on manufacturing tolerances and ensures a predetermined retaining force.

For activating the valve 33, i.e. shifting the valve 33 from a normally open position during motor operation at speed levels below the maximum speed level determined by the speed governor to a closed position at malfunction of the speed governor, the actuator 34 is intended to make the valve element 36 leave its open position and move towards the closed position. The actuator 34 comprises a spring wire rod 46 inserted in a co-axial bore 47 in the spindle 25. At its rear end the rod 46 carries an inertia contact element 48 which at a certain predetermined motor speed is displaced radially outwards by centrifugal action to hit the secondary portion 39 of the valve element 36, thereby making the latter loose its engagement with the magnet 43 and leave its open position.

In order to have the contact element 48 exposed to the centrifugal forces in a controlled way, the spindle 25 is provided with a support member 50 having an abutment surface 51 to keep the rear end of the rod 46 in a bent off-centre position in relation to the rotation axis of the spindle 25. Thereby, the contact element 48 is continuously exposed to centrifugal forces, and when the rotation speed exceeds the predetermined maximum speed level the centrifugal forces will dominate over the spring force of the rod 46 and move the contact element 48 outwards away from the abutment surface 51 in order to hit the secondary portion 39 of the valve element 36.

In a case of speed governor malfunction and an increasing motor speed above a predetermined maximum level, the actuator 34 is activated by centrifugal action to make the contact element 48 hit the valve element 36 and release the latter from its open position in which it is retained by the magnet 43. As soon as the valve element 36 is released from the magnet 43 the pressure air flow in the inlet passage 16 will immediately rotate the valve element 36 about the pivot spindle 37 to its closed position in contact with the valve seat 41. In this closed position the secondary portion 39 of the valve element 36 will be attracted by the magnet 43 such that the valve element 36 will be positively maintained in its closed position.

Due to the completely frictionless action of the actuator 34 and the very small guide surfaces of the pivot spindle 37 and due to the frictionless magnetic retaining means for the valve element 36, the reliability of the overspeed safety device according to the invention means a substantial improvement in relation to prior art devices.

It is to be noted that the invention is not limited to the described example but may be freely varied within the scope of the claims. Although particularly advantageous when applied on high speed motors, the device according to the invention is not exclusively intended for turbine motors.

What is claimed is:

1. An overspeed safety device for a pneumatic rotation motor with a stator with an air inlet passage, a rotor comprising a speed responsive actuator connected to the rotor for co-rotation therewith, and a valve shiftable by said actuator from an open position to a closed position, wherein said actuator comprises a contact element which is radially movable by centrifugal action between an inactive position and an active position, and a spring means arranged to maintain said contact element in said inactive position at motor speed levels below a predetermined maximum speed level and to permit said contact element to be displaced radially to said active position at motor speed levels above said maximum speed level to thereby accomplish shifting of said valve from said open position to said closed position;

wherein said valve comprises a disc-shaped valve element which is rotatable about a pivot axis for movement between said open position and said closed position, and wherein said valve element in said open position is located substantially in parallel with the inlet passage, and in said closed position said valve element is located transversely to the inlet passage;

wherein said pivot axis extends transversely to the inlet passage and is located in a laterally off-set position in relation to the rotation axis of the rotor in such a way that said valve element in said open position is out of reach by said contact element when said contact element occupies said inactive position, whereas said contact element in said active position reaches out radially to hit said valve element making said valve element shift from said open position to said closed position; and further comprising a retaining device for releasably holding said valve element in said open position.

2. The overspeed safety device according to claim 1, wherein:

said valve element is made of a ferrous material; and said retaining device comprises a first magnet which is mounted in the inlet passage and arranged to attract and hold said valve element in said open position, and a second magnet is arranged to attract and hold said valve element in said closed position.

3. The overspeed safety device according to claim 2, wherein the inlet passage is formed with an axially facing valve seat surface disposed substantially transverse to the inlet passage and arranged to be engaged by said valve element in said closed position.

4. The overspeed safety device according to claim 1, wherein the inlet passage is formed with an axially facing valve seat surface disposed substantially transverse to the inlet passage and arranged to be engaged by said valve element in said closed position.

5. The overspeed safety device according to claim 1, wherein said spring comprises a substantially straight rod connected to the rotor in a concentric disposition and having a free end carrying said contact element.

6. The overspeed safety device according to claim 2, wherein said spring comprises a substantially straight rod connected to the rotor in a concentric disposition and having a free end carrying said contact element.

7. The overspeed safety device according to claim 3, wherein said spring comprises a substantially straight rod connected to the rotor in a concentric disposition and having a free end carrying said contact element.

8. The overspeed safety device according to claim 4, wherein said spring comprises a substantially straight rod connected to the rotor in a concentric disposition and having a free end carrying said contact element.

9. The overspeed safety device according to claim 3, wherein said valve seat surface is part-circular.

10. The overspeed safety device according to claim 4, wherein said valve seat surface is part-circular.

* * * * *